United States Patent [19]

Cegielski, Jr. et al.

[11] Patent Number: 4,512,267

[45] Date of Patent: Apr. 23, 1985

[54] METHODS AND APPARATUS FOR COMBUSTING ASH PRODUCING SOLIDS

[75] Inventors: John M. Cegielski, Jr., Claremore; Gerald D. Campbell, Jenks; Clyde D. Schaub, Tulsa, all of Okla.

[73] Assignee: John Zink Company, Tulsa, Okla.

[21] Appl. No.: 573,470

[22] Filed: Jan. 24, 1984

[51] Int. Cl.[3] ..... F23D 1/00

[52] U.S. Cl. ..... 110/347; 110/264; 110/265; 431/9; 431/173

[58] Field of Search ..... 110/264, 265, 347; 431/9, 10, 173

[56] References Cited

U.S. PATENT DOCUMENTS

| | | | |
|---|---|---|---|
| Re. 16,984 | 6/1928 | Leach . | |
| 475,715 | 5/1892 | Wegener . | |
| 858,640 | 7/1907 | Welles . | |
| 867,177 | 9/1907 | Welles . | |
| 969,169 | 9/1910 | Lindhard . | |
| 1,141,214 | 6/1915 | Sneed . | |
| 1,955,574 | 4/1934 | Benner et al. . | |
| 2,385,508 | 9/1945 | Hammond . | |
| 2,616,252 | 11/1952 | Robinson et al. . | |
| 2,617,405 | 11/1952 | Keller | 110/264 X |
| 2,652,792 | 9/1953 | Yellott | 110/264 |
| 2,678,615 | 5/1954 | Soderlund et al. . | |
| 2,810,968 | 10/1957 | Pitt . | |
| 2,917,011 | 12/1959 | Korner | 110/264 |
| 3,124,086 | 3/1964 | Sage et al. | 110/264 |
| 3,453,976 | 7/1969 | Burden, Jr. et al. . | |
| 3,777,678 | 12/1973 | Lutes et al. . | |
| 3,831,535 | 8/1974 | Baardson . | |
| 3,856,455 | 12/1974 | Otway et al. . | |
| 3,859,935 | 1/1975 | Walker . | |
| 3,889,608 | 6/1975 | Pitt . | |
| 3,956,981 | 5/1976 | Pitt . | |
| 3,959,007 | 5/1976 | Pitt . | |
| 4,033,505 | 7/1977 | Lutes et al. . | |
| 4,047,489 | 9/1977 | Voorheis et al. . | |
| 4,057,021 | 11/1977 | Schoppe . | |
| 4,190,005 | 2/1980 | Cookson et al. . | |
| 4,310,299 | 1/1982 | Binasik et al. . | |

FOREIGN PATENT DOCUMENTS

| | | |
|---|---|---|
| 692391 | 6/1953 | United Kingdom . |
| 2081855 | 2/1982 | United Kingdom . |
| 2052032 | 5/1983 | United Kingdom . |
| 2059031 | 8/1983 | United Kingdom . |

*Primary Examiner*—Edward G. Favors

*Attorney, Agent, or Firm*—C. Clark Dougherty, Jr.

[57] ABSTRACT

Methods and apparatus for combusting particulated ash producing solids are provided. The methods include the steps of conveying the solids to an elongated cylindrical combustion chamber, combining air with the solids to form an air-solids mixture and longitudinally injecting the mixture into the combustion chamber wherein the solids are ignited and combusted. One or more streams of relatively cool gas are tangentially injected into the interior of the combustion chamber in directions transverse to the longitudinal axis thereof so that a helical vortex is created within and along the length of the combustion chamber and the flame, ash and hot gaseous products of combustion produced therein are caused to flow through the central portion of the combustion chamber surrounded by a sleeve of cooler gas. The ash and hot gases are cooled in the combustion chamber to solidify tacky or molten ash therein and the resulting solidify ash and gases are withdrawn from the combustion chamber.

26 Claims, 6 Drawing Figures

METHODS AND APPARATUS FOR COMBUSTING ASH PRODUCING SOLIDS

BACKGROUND OF THE INVENTION

1. Field of the Invention

The present invention relates generally to methods and apparatus for combusting particulated solids, and more particularly, but not by way of limitation, to methods and apparatus for combusting particulated solids which form tacky or molten ash at or near the combustion temperature.

2. Description of the Prior Art

A great variety of methods and apparatus for combusting particulated solids have been developed and utilized heretofore. However, in the combustion of particulated solids which form a tacky or molten ash at or near the combustion temperature, elaborate apparatus has heretofore been required and problems involving the precipitation and buildup of the ash produced on the internal surfaces of the apparatus have been encountered.

Examples of solid materials which produce a tacky or molten ash when combusted are seed and nut hulls, husks and chaff, sawdust, dried sewage sludge, etc. Such materials, for example rice hulls, have little utility other than being used as fuel and are available in large quantities. However, as mentioned above, because the materials form a tacky or molten ash when combusted, heretofore utilized combustion apparatus has been expensive and has not overcome problems associated with the precipitation and/or adherence of the ash to equipment surfaces.

By the present invention, improved methods and apparatus for combusting ash producing solids such as particulated rice hulls are provided which are simple and inexpensive as compared to prior art methods and apparatus and which obviate problems associated with the production of a tacky or molten ash.

SUMMARY OF THE INVENTION

A method of combusting particulated solids comprising conveying the particulated solids to an elongated cylindrical combustion chamber and injecting the solids longitudinally into the combustion chamber wherein the solids are combined with air, ignited and combusted. One or more streams of relatively cool gas are tangentially injected into the interior of the combustion chamber in a direction transverse to the longitudinal axis thereof so that a helical vortex is created within and along the length of the combustion chamber and the flame, ash and hot gaseous products of combustion produced therein are caused to flow through the central portion of the combustion chamber surrounded by a sleeve of the cooler gas. The ash and hot gaseous products of combustion are cooled to solidify the ash and the resultant stream of solidified ash and gases are withdrawn from the combustion chamber. Apparatus for carrying out the methods of the present invention are also provided.

It is, therefore, a general object of the present invention to provide methods and apparatus for combusting ash producing solids.

A further object of the present invention is the provision of an improved method of combusting tacky or molten ash producing solids such as particulated rice hulls and recovering heat therefrom whereby problems associated with ash build-up on equipment surfaces are minimized.

Yet a further object of the present invention is the provision of apparatus for combusting tacky or molten ash producing solids and recovering the heat therefrom which is relatively inexpensive to install and operate.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
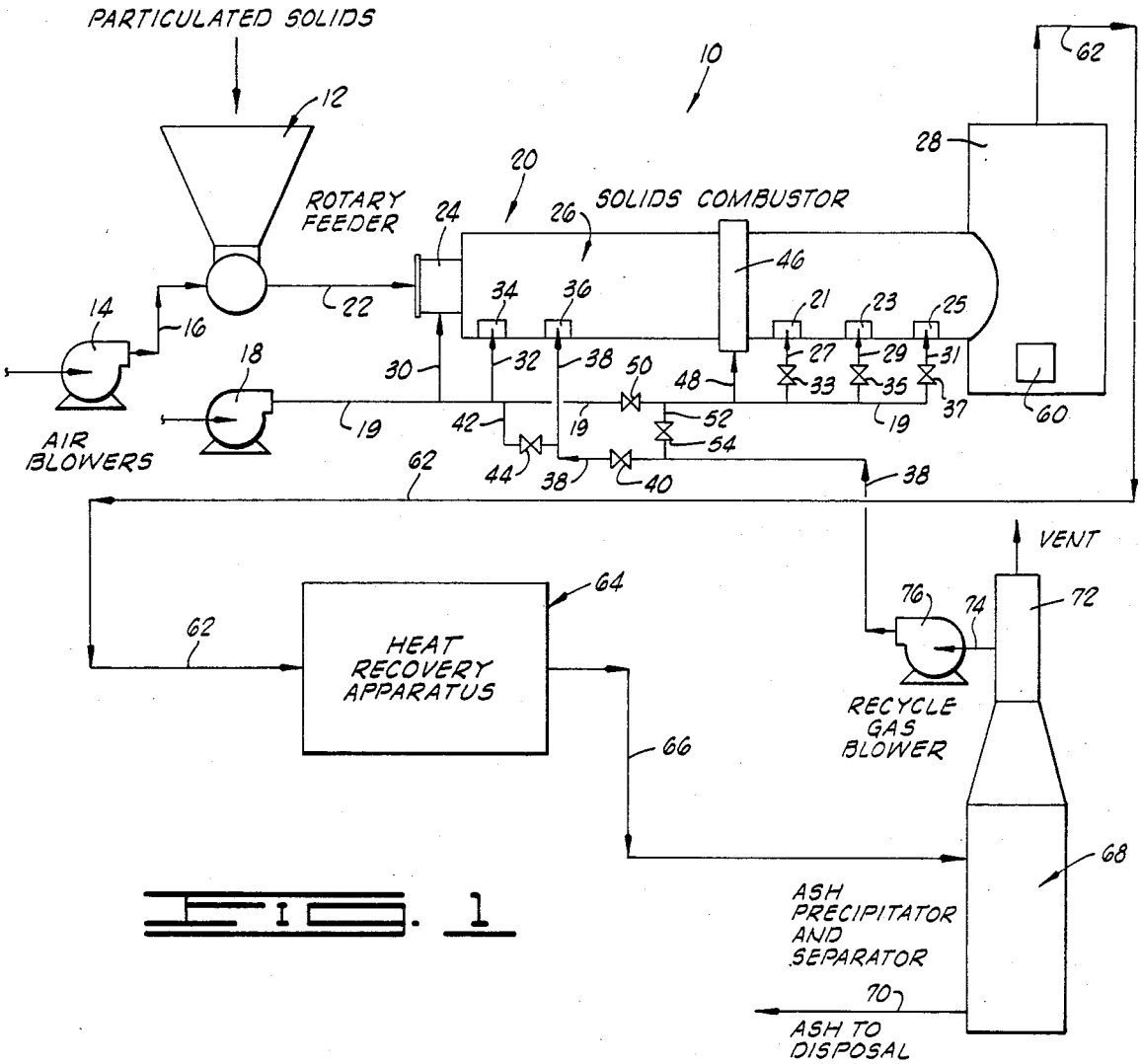
FIG. 1 is a schematic illustration of apparatus for carrying out the methods of the present invention.
Figure 2:
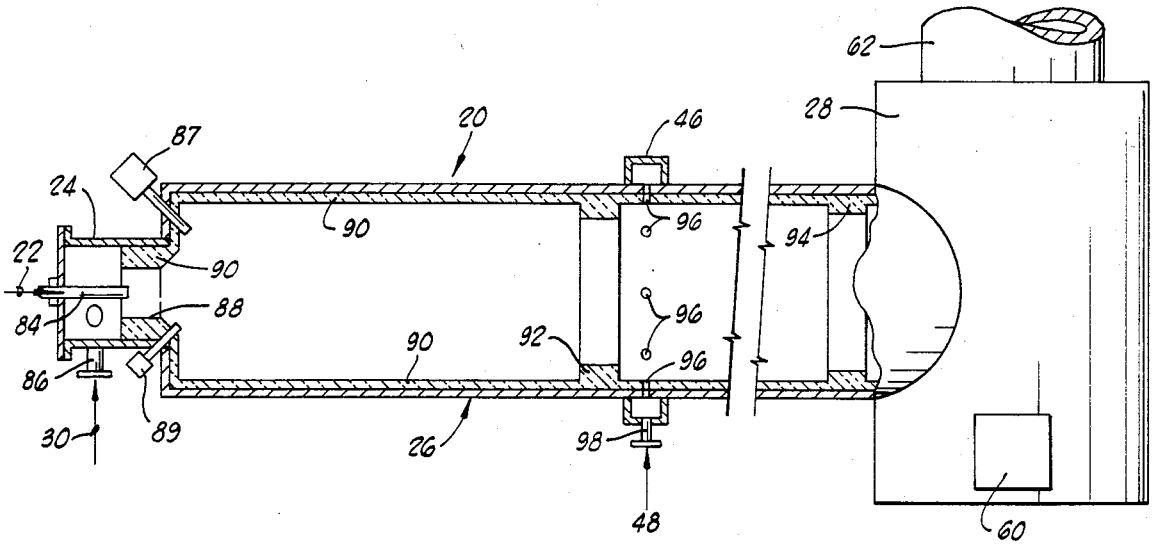
FIG. 2 is a side partly sectional elevational view of the solids combustor of FIG. 1.

Referring now to the drawings, and particularly to FIG. 1, a system of apparatus for carrying out the methods of this invention is schematically illustrated and generally designated by the numeral 10. The system 10 is comprised of a conventional solids rotary feeder apparatus 12 to which particulated solids to be combusted are transported. An air blower 14 is provided, the discharge connection of which is connected by a conduit 16 to the rotary feeder 12 which functions to combine particulated solids transported thereto with air. The resulting air-solids mixture is conveyed from the feeder to a solids combustor 20 by a conduit 22 connected therebetween.

As will be described in greater detail hereinbelow, the solids combustor 20 is comprised of an elongated cylindrical combustion chamber 26 having a burner portion 24 at the forward end thereof. The rearward end of the combustion chamber 26 includes a cylindrical mixing compartment 28 which is positioned transversely to the axis of the forward portion of the combustion chamber 26.

A second air blower 18 is provided, the discharge connection of which is connected to a conduit 19. A conduit 30 connects the burner portion 24 of the combustor 20 to the conduit 19 and a conduit 32 connects the conduit 19 to a tangential inlet connection 34 attached to the combustion chamber 26. A second tangential inlet connection 36 is attached to the combustion chamber 26 which has a conduit 38 connected thereto. The conduit 38 includes a shut-off valve 40 disposed therein and a conduit 42 connects between the conduit 19 and the conduit 38 having a shut-off valve 44 disposed therein. A cooling gas bustle 46 or equivalent means is sealingly connected to the combustion chamber 26 over a plurality of spaced inlet ports therein and a conduit 48 is connected between the conduit 19 and the bustle 46. A shut-off valve 50 is disposed in the conduit 19, and a conduit 52 is connected downstream of the valve 50 between the conduits 19 and 38. A shut-off valve 54 is disposed in the conduit 52. Three additional tangential inlets 21, 23, and 25 are attached to the combustion chamber 26 downstream of the bustle 46 which are connected to the conduit 19 by conduits 27, 29 and 31, respectively, having shut-off valves 33, 35 and 37 disposed therein, respectively.

The mixing compartment 28 at the rearward end of the chamber 26 includes an ash clean-out door 60 or other ash removal means connected thereto, and a conduit 62 connects the compartment 28 to a heat recovery apparatus 64.

While the heat recovery apparatus 64 can take various forms, it functions to remove heat from the stream of ash and hot combustion gases produced by the solids combustor 20 and conducted to the heat recovery apparatus 64 by the conduit 62. Generally, the heat recovery apparatus 64 is comprised of one or more heat exchangers whereby the hot stream of ash and gases from the combustor 20 is passed in indirect heat exchange relationship with another cooler stream so that heat is transferred to the cooler stream. For example, the cooler stream can be water which is converted to steam or it can be any other process stream.

From the heat recovery apparatus 64 the resulting relatively cool stream of ash and gases is conducted by a conduit 66 to an ash precipitator and separator 68. The ash precipitator and separator 68 brings about the separation of the ash from the gases flowing therethrough and the gases are vented to the atmosphere. The ash is withdrawn by way of a conduit or conveyor 70 connected to the bottom of the precipitator and separator 68 and the gases are withdrawn therefrom by way of a stack 72 connected to the top portion thereof. A conduit 74 for withdrawing a portion of the gases flowing through the stack 72 and recycling such gases to the combustor 20 is attached thereto and to a recycle gas blower 76. The discharge of the blower 76 is connected to the conduit 38.

It is to be understood that the tangential inlets 34, 36, 21, 23 and 25 can each be comprised of one or more tangential inlets connected together by a manifold. In addition, while the cylindrical mixing compartment 28 is preferably positioned transversely to the forward portion of the combustion chamber 26, it can be positioned coaxially therewith if desired.

Operation of the System 10

In operation of the system 10, particulated ash producing solids to be combusted are conveyed to the rotary feeder 12 wherein they are dispersed into the stream of air conducted thereto by the conduit 16. The resulting air-solids mixture is conducted to the burner portion 24 of the combustion chamber 26 by the conduit 22. Additional air is conducted to the burner portion 24 by the conduit 30 which is combined with the air-solids mixture flowing therethrough and the resulting air-solids mixture is injected longitudinally into the elongated cylindrical portion of the combustion chamber 26 wherein the mixture is combusted. It should be noted that the particulated solids can be conveyed to the combustion chamber 26 and combustion air mixed therewith using various conventional techniques and apparatus other than those described herein.

As will be described in detail hereinbelow, streams of relatively cool air and/or recycled combustion gases can be injected tangentially into the combustion chamber 26 by way of the tangential inlet connections 34, 36, 21, 23 and 25 and substantially radially into the chamber by way of the ports communicated with the bustle 46.

Primary combustion air is provided to the combustion chamber 26 by way of the conduit 30 connected to the burner portion 24 thereof. Additional combustion air is injected into the combustion chamber 26 by way of the tangential inlet 34. Depending upon the quantity of particulated solids being combusted and other factors, additional combustion air can be injected into the combustion chamber 26 by way of the tangential inlet 36 and/or the tangential inlets 21, 23 and 25 and the bustle 46. If the additional air is not needed, recycled combustion gases can be injected by way of the tangential inlets 36, 21, 23 and 25 and the bustle 46. If air is injected by way of the tangential inlet 36, the shut-off valve 44 in the conduit 42 is open and the shut-off valve 40 in the conduit 38 is closed. If recycle gas is injected, the valves 44 and 40 are reversed, i.e., the valve 44 is closed and the valve 40 is open.

As indicated, relatively cool air or recycle gas is injected into the combustion chamber 26 by way of the injection ports communicated with the bustle 46 and the tangential inlets 21, 23 and 25. The injection of this relatively cool gas into the combustion chamber 26 brings about the cooling of the products of combustion whereby tacky or molten ash therein is solidified.

The ports communicated with the bustle 46 inject the relatively cool gas transversely into the stream of solids, air, flame, ash and hot combustion gases flowing through the combustion chamber which causes mixing and complete combustion of the solids and air as well as the cooling of the products of combustion. As mentioned, if additional air is required to complete the combustion of the solids in the combustion chamber 26, it can be injected by way of the bustle 46 and tangential inlets 21, 23 and 25 to accomplish the dual function of providing additional combustion air and cooling the combustion products. However, it is preferred that recycle gases be injected by way of the bustle 46 and tangential inlets 21, 23 and 25 to reduce the production of atmosphere-polluting oxides of nitrogen in the combustion products. If air is injected by way of the bustle 46 and inlets 21, 23 and 25, the shut-off valve 50 in the conduit 19 is open and the shut-off valve 54 in the conduit 52 is closed. If recycle gases are injected by way of the bustle 46 and inlets 21, 23 and 25, the valves 50 and 54 are reversed, and if both air and recycle gases are injected, the valves 50 and 54 are both open. The valves 33, 35 and 37 in the conduits 27, 29 and 31 are used to selectively close one or more of the tangential inlets 21, 23 or 25.

The ash and hot gases produced in combustion chamber 26 flow into the mixing compartment 28 wherein the relatively cool gases injected into the combustion chamber 26 are intimately mixed with the ash and gases. That is, the change in the direction of flow of the ash and gases as they flow into and through the compartment 28 brings about the thorough mixing thereof and insures that all tacky or molten ash produced is solidified. The larger solidified ash particles gravitate to the bottom of the compartment 28 from where they are removed by way of the door 60 or other removal means. The stream of remaining solidified ash and hot gases is conducted from the compartment 28 to the heat recovery apparatus 64 by the conduit 62. As mentioned above, the stream of ash and gases is passed in heat exchange relationship with a cooler stream while flowing through the heat recovery apparatus 64 whereby heat is transferred from the stream of ash and gases to the cooler stream.

The resultant relatively cool stream of ash and gases which exits the heat recovery apparatus 64 is conducted to a conventional ash precipitator and separator apparatus 68 by the conduit 66. The apparatus 68 brings about the precipitation and separation of the ash from the gases and the ash is removed therefrom by way of the conduit or conveyor 70. The separated gases are vented to the atmosphere by way of the stack 72. When recycle gases are utilized in the combustor 20, a portion of the gases are withdrawn from the stack 72 by the conduit 74 and blower 76 and caused to flow through the conduit 38 to the combustor 20.

The Solids Combustor 20

Figure 3:
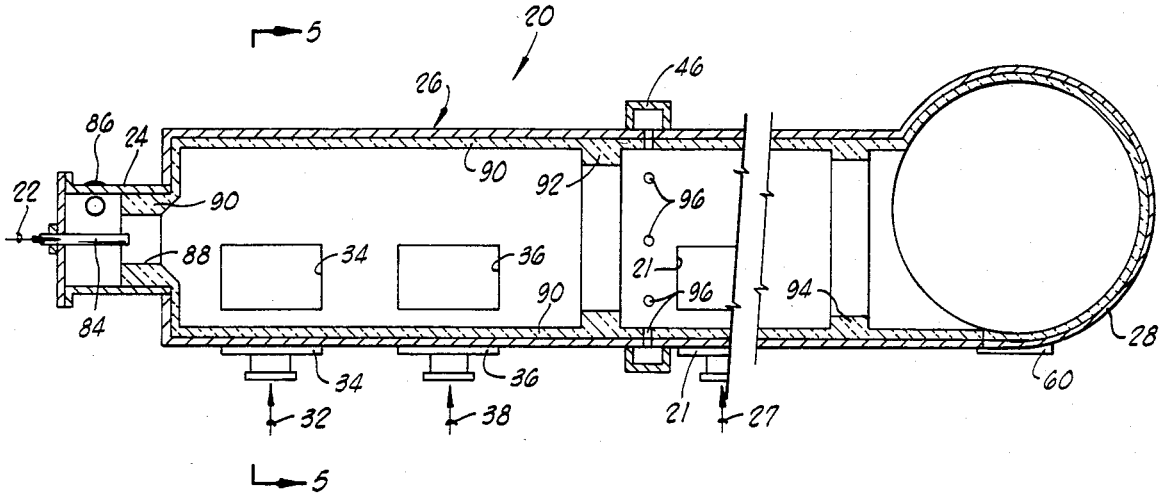
FIG. 3 a top sectional view of the solids combustor of FIG. 2

Referring now to FIGS. 2–5, the solids combustor 20 is illustrated in detail. As mentioned above, the combustor 20 is comprised of an elongated cylindrical combustion chamber 26 having a cylindrical burner portion 24 connected to the forward end thereof. The rearward portion of the combustion chamber 26 includes the mixing compartment 28 positioned transversely to the forward portion and preferably attached thereto tangentially as shown in FIG. 3.

The air-solids mixture conducted to the combustion chamber 26 by the conduit 22 is discharged longitudinally into the interior of the burner portion 24 by an axially positioned conduit 84. Primary combustion air enters the burner portion 24 tangentially by way of a nozzle 86 connected thereto which is in turn connected to the conduit 30, previously described. The air-solids mixture produced in the burner portion 24 flows longitudinally into the elongated cylindrical portion of the combustion chamber 26 by way of a nozzle 88 formed at the forward end thereof. All of the interior surfaces of the combustion chamber 26 are covered with a heat insulating, errosion-resistant material 90. A thickened portion of the material 90 extends a short distance into the cylindrical burner portion 24 forming the nozzle 88.

One or more conventional pilot flame burners 87 and pilot flame ignitors 89 are provided at the forward end of the combustion chamber 26 for igniting said insuring the continuous combustion of the air-solids mixture discharged thereto.

At a point approximately intermediate the ends of the combustion chamber 26 and within the interior thereof, an annular protuberance 92 may be provided in the insulating material 90 or in any other suitable manner. The protuberance 92 is continuous and extends radially inwardly a short distance so that a restricted circular cross-sectional flow area is provided thereby. In a like manner a protuberance 94 may be provided at a position adjacent the mixing compartment 28.

A plurality of spaced cooling gas injection ports 96 are disposed through the sides of the combustion chamber 26 for radially injecting gas thereinto positioned in a plane transverse to the axis of the combustion chamber 26 adjacent, but rearward of the protuberance 92. The bustle 46 is sealingly disposed over the injection ports 96 and air or recycle gases are provided to the bustle 46 by way of a nozzle 98 connected thereto which is in turn connected to the conduit 48.

Figure 4:
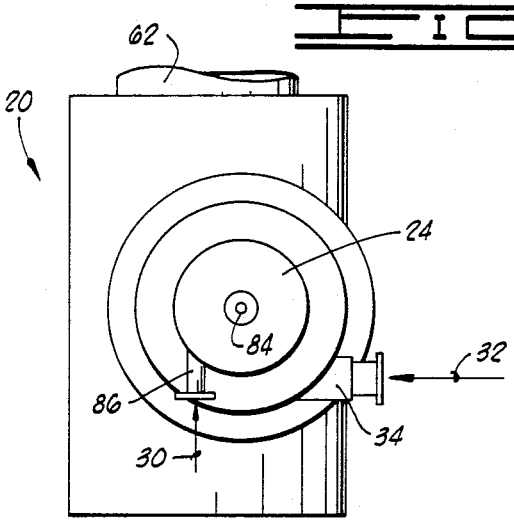
FIG. 4 is a front elevational view of the solids combustor of FIGS. 2 and 3.
Figure 5:
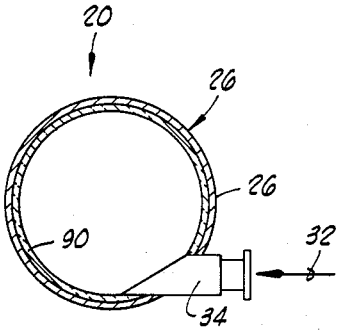
FIG. 5 is a cross-sectional view taken along 5—5 of FIG. 3.

As best shown in FIGS. 3–5, the tangential gas inlet nozzles 34, 36, 21, 23 and 25 extend through the sides of the combustion chamber 26 at directions transverse to the longitudinal axis thereof. The tangential inlet 34 is connected to the conduit 32, the tangential inlet 36 to the conduit 38 and the tangential inlets 21, 23 and 25 (only the inlet 21 is shown in FIG. 5) to the conduits 27, 29 and 31 as previously described.

Operation of the Solids Combustor 20

Figure 6:
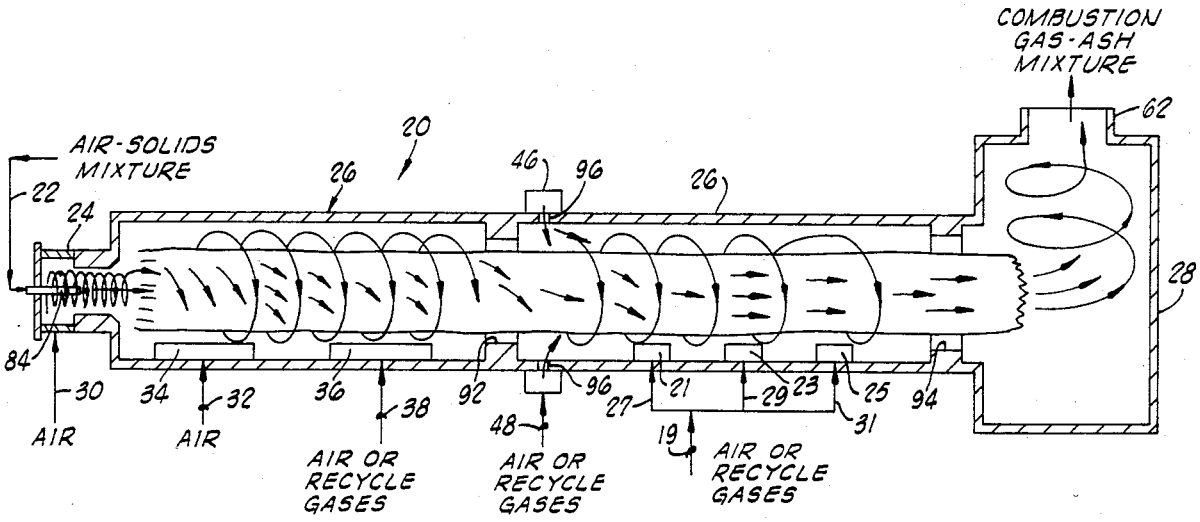
FIG. 6 is a diagrammatic illustration of the solids combustor of FIGS. 1–5 showing the flow of the various streams and flame therethrough.

In operation of the combustor 20, and as shown diagrammatically in FIG. 6, the air-solids mixture conducted to the combustor 20 by the conduit 22 flows through the conduit 84 and is injected longitudinally into the combustion chamber 26. The primary combustion air from the conduit 30 enters the burner portion 24 tangentially and is imparted a swirling motion as a result thereof. The swirling primary combustion air mixes with the air-solids mixture as it is injected into the forward end of the combustion chamber 26, and the resulting mixture is ignited by the pilot flame burner or burners 87 and combusted therewithin. A stream of additional air is tangentially injected into the interior of the combustion chamber 26 by way of the tangential inlet connection 34 and the conduit 32 connected thereto. Also, additional streams of air or relatively cool recycle gases can be tangentially injected into the combustion chamber 26 by way of the tangential inlet connections 36, 21, 23 and 25 and the conduits 38, 27, 29 and 31 connected thereto. The tangential injection of relatively cool air or air and recycle gases in a direction transverse to the longitudinal axis of the combustion chamber 26 creates a helical vortex within and along the length of the combustion chamber 26 which in turn causes the flame, ash and hot gaseous products of combustion produced by the combustion within the combustion chamber 26 to flow through the central portion of the combustion chamber and to be surrounded by a sleeve of relatively cool gas. The terms "relatively cool gas" and "relatively cool gases" are used herein to mean a gas or gases having temperatures below the freezing or solidification temperature of the ash produced within the combustion chamber 26.

The sleeve of relatively cool gas produced within the combustion chamber 26 causes any tacky or molten ash flowing therethrough to be cooled and solidified before contacting the interior surfaces of the combustion chamber 26. The radially inwardly extending protuberances 92 and 94 within the combustion chamber 26 provide flow area restrictions therewithin which help maintain the flame, ash and hot products of combustion centralized within the combustion chamber 26.

In order to bring about the additional mixing of solids and air and the cooling of combustion products in the combustion chamber 26, a stream of air and/or recycle gases is injected by way of the bustle 46 and ports 96 transversely into the central stream of flame, ash and combustion gases. As the injected cooling gases, ash and hot combustion gases flow rearwardly through the rearward portion of the combustion chamber 26 and through the mixing compartment 28, complete combustion of the solids and thorough mixing of the cooling gases with the ash and combustion gases produced whereby the ash is cooled and solidified take place. As mentioned above, some of the larger ash particles accumulate in the bottom of the compartment 28 from where they are removed.

Because tacky or molten ash is maintained centrally in the combustion chamber 26 as it is being cooled and solidified, and because the tacky or molten ash and hot products of combustion are surrounded by a sleeve of relatively cool gas whereby ash flowing towards the interior surfaces of the combustion chamber 26 is solidified before reaching the surfaces, ash does not precipitate, adhere to or build up on the interior surfaces of the combustion chamber 26. As will be understood, relatively cool gases other than air or recycled combustion gases can be utilized in accordance with the present invention, e.g., steam, nitrogen or other inert gases.

Thus, the present invention is well adapted to carry out the objects and attain the ends and advantages mentioned as well as those inherent therein. While presently preferred embodiments of the invention have been described herein for purposes of disclosure, numerous changes in the arrangement of steps and in the construction and arrangement of parts can be made by those skilled in the art, which changes are encompassed within the spirit of this invention as defined by the appended claims.

What is claimed is:

1. A method of combusting particulated ash producing solids comprising:

conveying said particulated solids to an elongated cylindrical combustion chamber;

combining air with said solids and injecting the resulting air-solids mixture longitudinally into said combustion chamber wherein the solids are ignited and combusted;

tangentially injecting a stream of relatively cool gas into the interior of said combustion chamber in a direction transverse to the longitudinal axis thereof so that a helical vortex is created within and along the length of said combustion chamber and the flame, ash and hot gaseous products of combustion produced therein are caused to flow through the central portion of the combustion chamber surrounded by a sleeve of a cooler gas whereby tacky or molten ash is substantially prevented from adhering to the interior surfaces of said combustion chamber;

cooling said ash and hot gaseous products of combustion in said combustion chamber whereby tacky or molten ash is solidified therein; and withdrawing the resultant cooled stream of solidified ash and gases from said combustion chamber.

2. The method of claim 1 which is further characterized to include the additional step of separating solidified ash from said cooled stream of solidified ash and gases withdrawn from said combustion chamber.

3. The method of claim 1 wherein said tangentially injected relatively cool gas is additional air.

4. The method of claim 2 wherein said tangentially injected relatively cool gas is comprised of gases withdrawn from said combustion chamber which are cooled and recycled thereto.

5. The method of claim 2 wherein said tangentially injected relatively cool gas is comprised of both additional air and cooled recycled gases.

6. The method of claim 2 wherein the step of cooling the ash and hot gaseous products of combustion in said combustion chamber comprises combining additional relatively cool gas therewith.

7. The method of claim 6 wherein said additional relatively cool gas is additional air.

8. The method of claim 6 wherein said additional relatively cool gas is comprised of gases withdrawn from said combustion chamber which are cooled and recycled thereto.

9. The method of claim 6 wherein said additional relatively cool gas is comprised of both additional air and cooled recycled gases.

10. The method of claim 1 which is further characterized to include the step of passing said ash and gases withdrawn from said combustion chamber in indirect heat exchange relationship with a process stream to thereby transfer heat from said ash and gases to said process stream.

11. The method of claim 10 which is further characterized to include the steps of separating said ash from said gases and conducting said gases to a point of further use or disposal.

12. A method of combusting particulated ash producing solids and recovering heat therefrom comprising:

(a) combining air with said particulated solids;

(b) injecting the resulting air-solids mixture into an elongated cylindrical combustion chamber wherein the solids are ignited and combusted;

(c) tangentially injecting relatively cool gas into the interior of said combustion chamber in a direction transverse to the longitudinal axis thereof so that a helical vortex is created within and along the length of said combustion chamber and the flame, ash and hot gaseous products of combustion produced therein are caused to flow through the central portion of the combustion chamber surrounded by a sleeve of cooler gas whereby tacky or molten ash is substantially prevented from adhering to the interior surfaces of said combustion chamber;

(d) cooling the resultant ash and gases in said combustion chamber whereby tacky or molten ash is solidified;

(e) passing said solidified ash and gases in indirect heat exchange relationship with a cooler process stream to thereby recover heat from said ash and gases by transferring heat to said process stream;

(f) separating the solidified ash from the gases; and (g) conducting said gases to a point of further use or disposal.

13. The method of claim 12 wherein said tangentially injected relatively cool gas of step (c) is additional air.

14. The method of claim 12 wherein said tangentially injected relatively cool gas of step (c) is comprised of cooled recycle gases from step (g).

15. The method of claim 12 wherein said tangentially injected relatively cool gas of step (c) is comprised of both additional air and cooled recycle gases.

16. The method of claim 12 wherein the cooling of the ash and gases in accordance with step (d) comprises combining additional relatively cool gas therewith.

17. The method of claim 16 wherein said additional relatively cool gas is additional air.

18. The method of claim 16 wherein said additional relatively cool gas is comprised of recycle gases from step (g).

19. The method of claim 16 wherein said additional relatively cool gas is both additional air and cooled recycle gases.

20. The method of claim 16 wherein said particulated ash producing solids are particulated seed hulls.

21. The method of claim 16 wherein said particulated ash producing solids are particulated rice hulls.

22. Apparatus for combusting ash producing solids comprising:

an elongated cylindrical combustion chamber for igniting and combusting said solids having an inlet end and an outlet end, having at least one tangential gas inlet connection connected thereto and positioned near the inlet end thereof to tangentially inject relatively cool gas into said chamber in a direction transverse to the axis thereof whereby flame, ash and hot products of combustion are caused to flow through the central portion of said combustion chamber surrounded by a sleeve of cooler gas and tacky or molten ash is substantially prevented from adhering to said combustion chamber, and having at least one additional gas inlet connection attached thereto at a point between said tangential gas inlet connection and the outlet end thereof for injecting additional relatively cool gas thereinto and thereby cooling and solidifying tacky or molten ash therein;

means for combining said ash producing solids with air and injecting the resulting solids-air mixture longitudinally into said combustion chamber attached to the inlet end thereof;

means for producing a stream of relatively cool gas attached to said tangential gas inlet connection; and means for producing a stream of relatively cool gas attached to said additional gas inlet connection.

23. The apparatus of claim 22 which is further characterized to include heat recovery means for recovering heat from a stream of ash and hot gases having an inlet connection and an outlet connection, the inlet connection being connected to the outlet end of said combustion chamber.

24. The apparatus of claim 23 which is further characterized to include means for separating ash from gases and venting the gases to the atmosphere connected to the outlet connection of said heat recovery means.

25. The apparatus of claim 24 wherein said means for producing a stream of cool gas comprises an atmospheric air blower having an atmospheric air inlet and an air discharge connection, the discharge connection being connected to said tangential gas inlet connection.

26. The apparatus of claim 25 wherein said combustion chamber includes two or more tangential gas inlet connections attached thereto, and wherein said apparatus is further characterized to include means for recycling a stream of gases from said means for separating and venting gases to one or more of said tangential gas inlet connections.

* * * * *